US005167131A

United States Patent [19]

Karkhanis

[11] Patent Number: 5,167,131

[45] Date of Patent: Dec. 1, 1992

[54] AIR CONDITIONING UNIT

[76] Inventor: Rajiv K. Karkhanis, 1023 Blue Ridge Dr., Harrisonburg, Va. 22801

[21] Appl. No.: 779,918

[22] Filed: Oct. 21, 1991

[51] Int. Cl.[5] ..... F25D 23/12

[52] U.S. Cl. ..... 62/262; 454/203; 454/204

[58] Field of Search ..... 62/262, 263; 454/201, 454/203, 204

[56] References Cited

U.S. PATENT DOCUMENTS

| | | | |
|---|---|---|---|
| 2,320,436 | 6/1943 | Hull | 62/129 |
| 2,760,354 | 8/1956 | Brady et al. | 62/262 |
| 3,176,474 | 4/1965 | Abbott | 62/280 |
| 3,246,593 | 4/1966 | Jacobs | 62/262 X |
| 3,296,820 | 1/1967 | Bauman | 62/262 |
| 3,302,426 | 2/1967 | Laing | 62/263 X |
| 3,306,181 | 2/1967 | Woods | 62/262 X |
| 3,392,546 | 7/1968 | Reed | 62/262 |
| 3,416,329 | 12/1968 | Thomas | 62/262 |
| 3,448,590 | 6/1969 | Eberhart | 62/262 |
| 3,476,034 | 11/1969 | Ulich | 62/262 X |
| 3,491,549 | 1/1970 | Oglesby | 62/262 |
| 3,552,139 | 1/1971 | Ulich | 62/262 |
| 3,665,726 | 5/1972 | Preotle | 62/262 |

FOREIGN PATENT DOCUMENTS

| | | | |
|---|---|---|---|
| 3142280 | 12/1982 | Fed. Rep. of Germany | 62/263 |

*Primary Examiner*—William E. Tapolcai

*Attorney, Agent, or Firm*—Bean, Kauffman & Spencer

[57] ABSTRACT

A saddle type room air conditioning unit is disclosed wherein evaporator and condenser housings are supported in a fixed relationship by a connecting portion affording support for the housings and controlled air flow communication between the housings. Sealing devices are releasably latched to the connecting portion and cooperate therewith to completely seal the unit vertically relative to a window sill and sash and horizontally between vertical sides of a window frame. A latching device is also disclosed for adjustably releasably latching upper and lower window sashes relative to one another, as required to prevent unauthorized removal of the unit from a window opening.

11 Claims, 2 Drawing Sheets

AIR CONDITIONING UNIT

BACKGROUND OF THE INVENTION

Saddle type room air conditioning units having an evaporator mounted within a housing intended to be arranged in a room to be cooled and an air cooled condenser mounted within a housing intended to be arranged exteriorly of a building and operably connected to the evaporator by conduits extending through a room window opening are well known, as evidenced for example by U.S. Pat. Nos. 2,320,436; 3,176,474 and 3,296,820.

SUMMARY OF THE INVENTION

The present invention is directed towards improvements in saddle type room air conditioning units.

In accordance with a preferred form of the present invention, an evaporator mounted within a housing intended to be arranged in a room to be cooled and an air cooled condenser mounted within a housing intended to be arranged exteriorly of a building and operably connected to the evaporator by conduits passing through a connecting section, which is intended to be arranged to extend through a room window opening and to support the housings relative to a sill of a window frame in a fixed, spaced relationship. The connecting section may include an air passageway extending between the housings and flow of air therethrough may be adjustably controlled by means accessible to a user from within the room to be cooled.

The housings or inner and outer sections and the connecting section are preferably fabricated from a pair of rigid channel members which support the weight of the housings relative to the window sill and a plurality of exterior panels, which are uniquely shaped so as to allow the whole of the exterior surfaces of the three sections of the present unit to be formed by as few as five panels, thereby minimizing manufacturing and assembly costs.

The present air conditioning unit additionally features adjustable sealing devices removably arranged to cooperate with the connecting section to completely seal the opening between the window sill and a lower window sash, which is created by supporting the connecting section on the window sill. When assembled and releasably latched to the connecting portion by novel latch devices of the present invention, the sealing devices define a strong, rigid barrier preventing exterior access to the room to be cooled.

The present invention additionally features an adjustable latching device serving to releasably lock lower and upper sashes of a window against relative movement after installation of the unit within a window opening.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
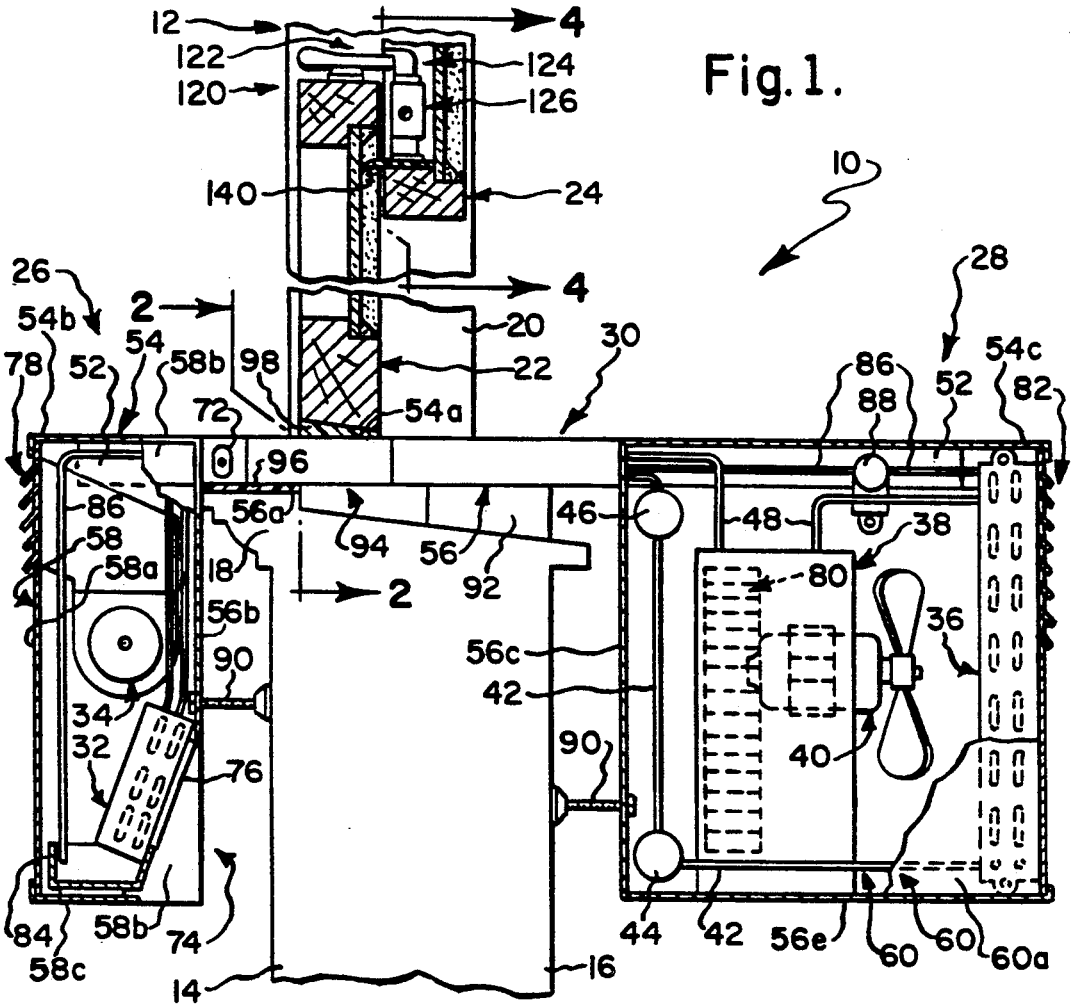
FIG. 1 is a vertical sectional view taken lengthwise through the air conditioning unit of the present invention showing same positioned within a window opening.

Reference is first made to FIG. 1, wherein an air conditioning unit of the present invention is generally designated as 10 and shown as being mounted in a window opening 12 of a building having interior and exterior wall surfaces 14 and 16. As is conventional, window opening 12 is bounded by a frame including a window sill 18, a pair of vertically extending sides, only one of which is shown at 20, and a connecting upper end, not shown. A suitable closure, such as may be defined by lower and upper window sashes 22 and 24 are fitted within and supported by the frame for relative vertical sliding movement for purposes of opening and closing window opening 12.

Unit 10 generally includes inner and outer sections 26 and 28 adapted to be disposed relatively inwardly and outwardly of wall surfaces 14 and 16, respectively, and connecting section 30 sized to freely extend through window opening 12 and for rigidly interconnecting the inner and outer sections with fixed spacing therebetween exceeding the distance or spacing between the wall surfaces, as shown in FIG. 1. As is known in prior constructions, inner section 26 is intended to house a refrigerant evaporator 32 and a fan 34 for drawing interior air across the evaporator; and outer section 28 is intended to house a refrigerant condenser 36, a compressor 38 and a fan 40 for forcing exterior air through the condenser. Condenser 36 is connected to evaporator 32 via refrigerant line 42 in which are disposed a receiver 44, an expansion device 46 and via a refrigerant line 48 in which is disposed compressor 38, and such refrigerant lines are arranged to extend between inner and outer sections 26 and 28 through connecting section 30. The refrigerant circuit generally depicted in FIG. 1 is conventional in all respects, and may be modified, as desired, to accommodate the unit of the present invention for use in a desired environment or under desired operating conditions.

Figure 2:
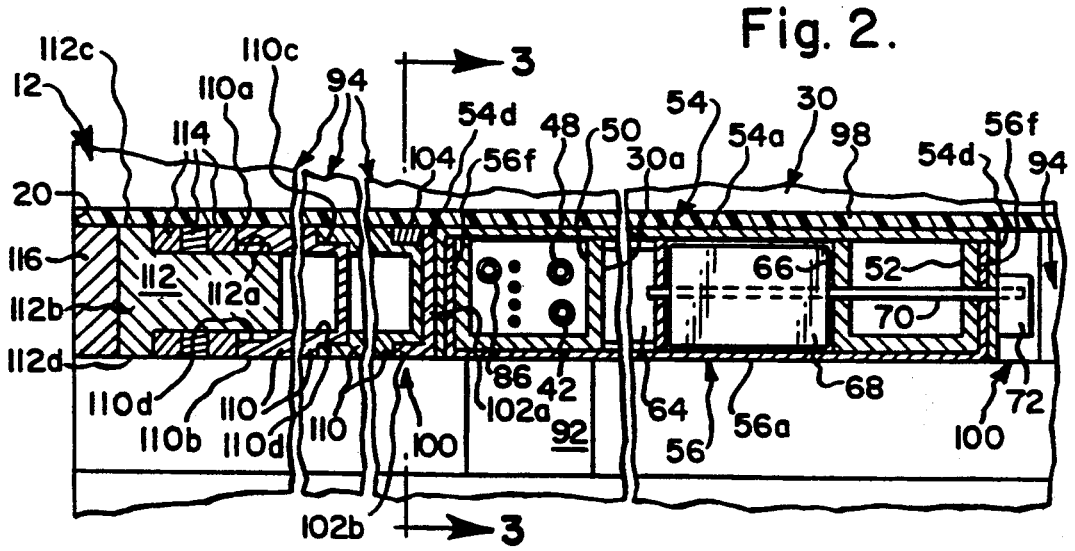
FIG. 2 is a fragmentary sectional view taken generally along the line 2—2 in FIG. 1.

In a preferred form of the invention, sections 26, 28 and 30 are primarily fabricated from sheet metal or plastic housing panels to be described and a pair of rigid, parallel channel members 50 and 52, which extend lengthwise through connecting section 30 and have their opposite ends disposed within inner and outer sections 26 and 28 for affording support therefor and fixing the inner and outer sections in a desired spaced apart relationship. The housing panels are shown in FIGS. 1 and 2 as including an upper panel 54, which defines an upper sealing surface **54*a* of section 30 and upper surfaces 54*b* and 54*c* of sections 26 and 28; a lower panel 56, which is shaped to define a lower sealing surface 56*a* of section 30, facing surfaces 56*b* and 56*c* of sections 26 and 28 arranged in spaced relationship to building wall surfaces 14 and 16, and a lower surface 56*e* of section 28; a front panel 58, which is shaped to define an inner surface 58*a*, oppositely facing end surfaces 58*b*, and a partial lower surface 58*c* of section 26; and a pair of end panels 60,60, which define oppositely facing end surfaces 60*a*, only one of which is shown in FIG. 1, of section 28. The central portion of upper and lower panels 54 and 56** are provided with overlapping flanges 54*d* and 56*f* which are fixed to channel members 50 and 52 to provide connecting section 30 with a rigid box-shaped cross-sectional configuration, wherein the channels bound an open central conduit 30*a* extending between the interiors of inner section 26 and outer section 28. Conduit 30*a* is partially obstructed by a four flanged bracket 64, which cooperates with channel 52, upper panel 54 and lower panel 56 to define a flow opening 66. Flow of air through opening 66 may be adjustably controlled by valve means including a valve plate 68 fixed to a supporting shaft 70 journalled adjacent its opposite ends by aligned bearing openings formed in bracket 64 and channel member 52 and adjacent ones of flanges 54*d* and 56*f*. An operator handle 72 fixed to an outwardly projecting end of shaft 70 is accessible from within the building to control the rotatable position of valve plate 68 and thus the degree of obstruction of flow opening 66.

In the construction illustrated in FIG. 1, a lower end portion of lower panel surface 56*b* cooperates with an end portion of front panel surface 58*c* to define an air inlet 74 communicating with refrigerant evaporator 32 via a suitable filter 76 removably insertable through such air inlet; and the portion of front panel 58, which defines inner surface 58*a*, is formed with louvered openings cooperating to define an air outlet 78 communicating with the refrigerant evaporator via fan 34. Further, in this construction, at least one of end panels 60,60 of outer section 28 is formed with louvered openings cooperating to define an air inlet 80 communicating with refrigerant condenser 36, and an outer surface of the outer section is formed with an air outlet opening 82 bounded for example by adjacent outer free edges of upper panel 54, lower panel 56 and end panels 60,60. In a preferred construction, inner section 26 houses a condensate receiver 84 arranged to receive condensate collecting on refrigerant evaporator 32 and collected condensate is applied for flow downwardly across refrigerant condenser 36 via a conduit 86 and a pump 88 located within outer section 28.

Figure 3:
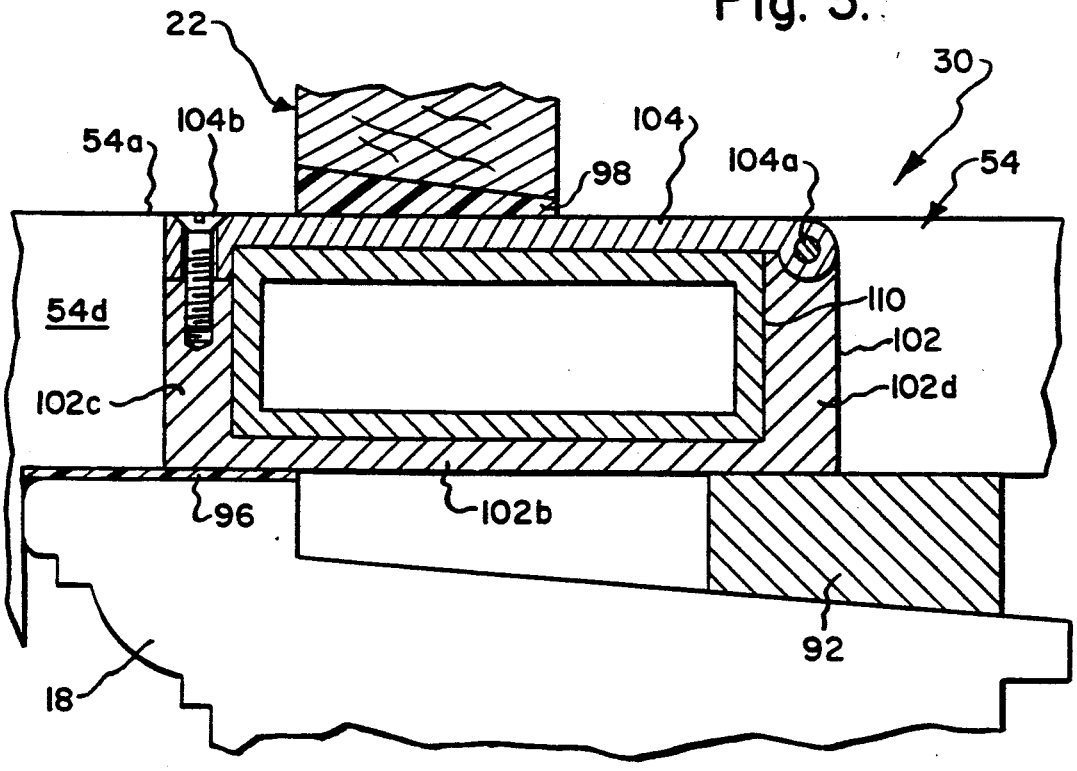
FIG. 3 is an enlarged sectional view taken generally along the line 3—3 in FIG. 2.

Unit 10 may be adjustably positioned relative to interior and exterior building wall surfaces 14 and 16 by any suitable means. Preferably, however, at least one of inner and outer sections 26 and 28 is provided with threadably adjustable spacer bolts 90 arranged to engage with wall surfaces 14 and/or 16. If required, suitable support blocks 92 may be inserted beneath connecting section 30, as shown in FIGS. 1–3.

Unit 10 is preferably positioned transversely within window opening 12 by adjustable length sealing devices 94,94 arranged to extend horizontally from adjacent oppositely facing mounting surfaces defined by upper panel flanges 54*d* for engagement with frame sides 20 and vertically between upper and lower sealing surfaces 54*a* and 56*a*. The lower surfaces of sealing devices 94,94 and lower sealing surface 56*a* may be fluid sealed relative to window sill 18 by a suitable gasket or sealing strip 96, and the upper surfaces of the sealing devices and upper sealing surface 54*a* may be fluid sealed relative to lower sash 22 by a suitable gasket or sealing strip 98.

Sealing devices 94,94 are releasably latched in position between the mounting surfaces of connecting section 30 and frame sides 20 by a pair of latch devices 100,100. Latch devices 100,100 are best shown in FIGS. 2 and 3 as each including a receiver 102, which opens away from its associated mounting surface and upwardly relative to upper sealing surface 54*a*, as shown in FIGS. 2 and 3, for receiving an end of one of sealing devices 94, and a retainer member 104 for removably retaining such end within the receiver. More specifically, in the illustrated construction, receiver 102 includes an end wall 102*a* fixed to an associated upper panel flange 54*d*, a lower wall 102*b*, an inner wall 102*c* and an outer wall 102*d*; and retainer member 104 has its outer end pivotally connected by hinge device 104*a* to outer wall 102*d* and its inner end releasably locked to inner wall 102*c*, as by a threaded fastener 104*b* accessible only from within the interior of the building. When retainer member 104 is locked in closed position as shown in FIGS. 2 and 3, its upper surface is aligned with upper sealing surface 54*a*. The lower surface of lower wall 102*b* is always disposed in alignment with lower sealing surface 56*a*.

Each of sealing devices 94 typically includes at least one spacer 110 having upper and lower sealing surfaces 110*a* and 110*b*, a stepped closed first end 110*c* sized to be removably slidably received within the open end of receiver 102 and a stepped open second end 110*d*, which is sized to removably slidably receive the first end 110*c* of a second spacer 110 if same is required to be employed. Each of sealing devices 94 further includes a stopper 112 having a mounting end 112*a* sized to removably slidably receive within the interior of one of spacers 110 through its second end 110*d* and an enlarged head end 112*b* having upper and lower sealing surfaces 112*c* and 112*d* arranged for alignment with sealing surfaces 110*a* and 110*b*; and at least one sealing ring 114 adapted to removably encircle stopper mounting end 112*a* between stopper head end 112*b* and second end 110*d* of the spacer into which the stopper is inserted. If desired, stopper head end 112*b* may be fitted with a resiliently deformable gasket 116 to facilitate sealing of the stopper relative to window frame side 20. The number of spacers 110 and sealing rings 114 employed may be varied as required to fill and fluid seal the opening between sill 18 and lower sash 22 intermediate connecting section 30 and frame sides 20. The construction of latch devices 100,100 serves to positively lock sealing devices 94,94 in position while permitting removal thereof whenever lower sash 22 is raised and fastener 104*b* is removed to permit hinged opening movement of retainer member 104.

Figure 4:
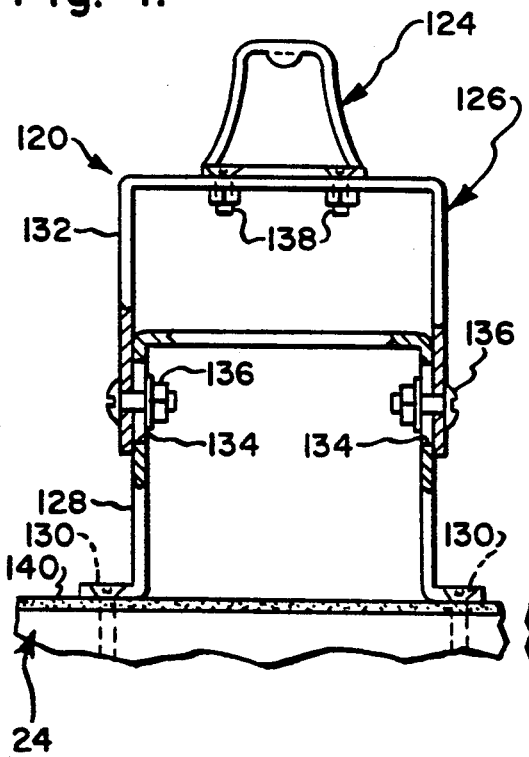
FIG. 4 is an enlarged sectional view taken generally along the line 4—4 in FIG. 1.

The present invention also includes sash latch means 120 for use in releasably connecting lower and upper sashes 22 and 24 for preventing relative movement therebetween and separating movement of the lower sash from sealing engagement with upper sealing surface 54*a* and sealing devices 100 or the upper sash from sealing engagement with the upper extent of the window frame. In a preferred construction shown in FIG. 4, latch means 120 includes an operable latch part 122 mounted on an upper extent of lower sash 22, a movable latch part 124 and adjustment means 126 for mounting latch part 124 on a lower extent of upper sash 24 for operative alignment with latch part 122, when the lower and upper sashes are arranged as indicated in FIG. 1. If desired, latch parts 122 and 124 may be of the type conventionally employed to lock sashes in a window closed condition, wherein latch part 122 is rotatable to removably bridge across the horizontal space between the sashes to releasably engage latch part 124. Adjustment means 126 is shown in FIGS. 1 and 4 as including a first bracket 128 fixed to upper sash 24, as by fasteners 130, and a second bracket 132 supported for vertical sliding movement relative to the first bracket and releasably/adjustably attached thereto via vertically elongated aligned slots 134 formed in the first bracket and threaded fasteners 136 carried by the second bracket for receipt within slots 134. Latch part 124 may be suitably fixed to second bracket 132 by threaded fasteners 138.

For window installations where latch parts 122 and 124 are already mounted on lower and upper sashes 22 and 24, latch part 122 may be left in its original position and latch part 124 removed from its original position on the upper sash and fixed to second bracket 132. Alternatively, the original latch part 124 may be left in position, and a new or separate like latch part provided with adjustment means 126. The first procedure would appear preferable, since it allows the installation of a resiliently deformable sealing strip 140 between the base of first bracket 128 and sash 24, as shown in FIGS. 1 and 4, without requiring that a hole be cut in such sealing strip to allow same to fit downwardly over the original latch part, if it were to be allowed to remain in its original position. The provision of resilient sealing strip 140 is desirable in that it ma closely follow the contour of the outer surface of lower sash 22, including its glass pane, in order to prevent leakage of air between the sashes.

Figure 5:
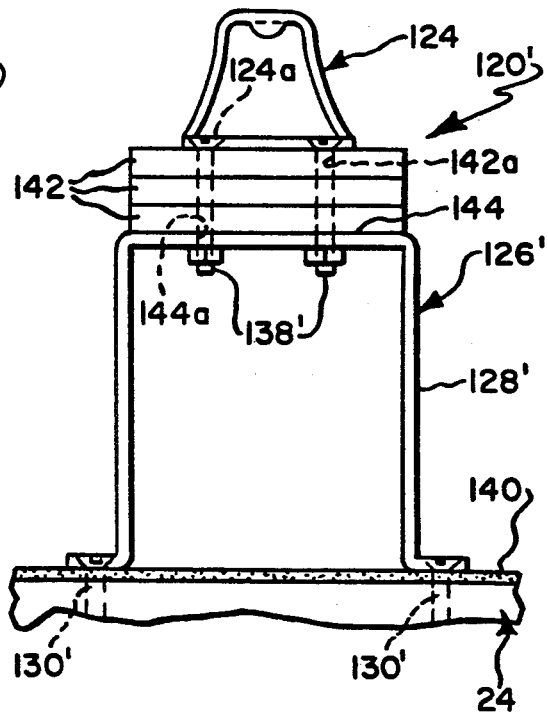
FIG. 5 is a sectional view similar to that shown in FIG. 4, but showing an alternative construction.

FIG. 5 illustrates an alternative construction of the sash latch means wherein like parts are designated by like primed numerals. This construction differs from that illustrated in FIG. 4, in that the second bracket is replaced by a plurality of relatively thin spacer plates 142 adapted to be selectively, removably mounted in a stacked relationship on an upper mounting surface 144 of first bracket 128'. The spacer plates are provided with mounting openings **142*a* extending therethrough for alignment with mounting openings 124*a* of latch part 124 and mounting openings 144*a* extending through mounting surface 144. Threaded fasteners 138' serve to clamp spacer plates 142 between mounting surface 144 and latch part 124. As for the case of the embodiment of FIG. 4, an original latch part 124 may be removed from upper sash 24 and mounted on adjustment means 126'** or left in place and an additional latch part furnished as part of the adjustment means.

What is claimed is:

1. An air conditioner unit adapted for insertion in a window opening of a building having interior and exterior wall surfaces adjacent said window opening, said window opening being bounded by a frame including a lower sill, a pair of vertical sides and a connecting upper end and closable by a closure movable within said frame, said unit comprising:

inner and outer sections adapted to be disposed relatively inwardly and outwardly of said interior and exterior wall surfaces, respectively; a connecting section sized to freely extend through said window opening and for rigidly interconnecting said inner and outer sections with a fixed spacing therebetween exceeding a distance, as measured between said interior and exterior wall surfaces, said inner and outer sections having facing surfaces, means for releasably retaining said facing surfaces in fixed position relative to said interior and exterior wall surfaces, said inner section housing a refrigerant evaporator, said outer section housing a refrigerant condenser and compressor and a refrigerant line passing therebetween and said connecting section housing refrigerant lines for connecting said evaporator to said compressor and said condenser to said evaporator, said connecting section having a generally rectangular cross-sectional configuration bounded by upper and lower sealing surfaces for weather sealing said connecting section to said sill and said closure and mounting surfaces arranged for facing spaced relationship to said vertical sides; adjustable length sealing devices arranged to removably extend horizontally from adjacent said mounting surfaces to said vertical sides and vertically between said upper and lower sealing surfaces; and latch devices for releasably latching said sealing devices against movement relative to said mounting surfaces, each of said latch devices includes a receiver opening away from an associated one of said mounting surfaces and upwardly relative to said upper sealing surface for removably receiving one of said sealing devices and a retainer member for retaining said one of said sealing devices within said receiver.

2. A unit according to claim 1, wherein said receiver has inner and outer walls, and said retainer member is hinge connected to said outer wall and releasably locked to said inner wall for retaining said one of said sealing devices within said receiver.

3. A unit according to claim 1, wherein said one of said sealing devices includes at least one spacer having upper and lower sealing surfaces, a stepped first end sized to be removably received within said receiver and open second end; a stopper having a mounting end adapted to be slidably receivable within said open second end of said spacer and an enlarged head end having upper and lower sealing surfaces, said upper and lower sealing surfaces of said spacer and said head end being arranged for alignment with said upper and lower sealing surfaces of said connecting portion; and at least one sealing ring adapted to removably encircle said mounting end of said stopper between said head end and said open second end of said spacer for bridging between said upper and lower sealing surfaces of said spacer and said head end of said stopper and cooperating with said spacer and said stopper for adjusting the length of said one of said sealing devices.

4. An air conditioner unit adapted for insertion in a window opening of a building having interior and exterior wall surfaces adjacent said window opening, said window opening being bounded by a frame including a lower sill, a pair of vertical sides and a connecting upper end and closable by a closure movable within said frame, said unit comprising:

inner and outer sections adapted to be disposed relatively inwardly and outwardly of said interior and exterior wall surfaces, respectively; a connecting section sized to freely extend through said window opening and for rigidly interconnecting said inner and outer sections with a fixed spacing therebetween exceeding a distance, as measured between said interior and exterior wall surfaces, said inner and outer sections having facing surfaces, means for releasably retaining said facing surfaces in fixed position relative to said interior and exterior wall surfaces, said inner section housing a refrigerant evaporator, said outer section housing a refrigerant condenser and compressor and a refrigerant line passing therebetween and said connecting section housing refrigerant lines for connecting said evaporator to said compressor and said condenser to said evaporator, said connecting section having a generally rectangular cross-sectional configuration bounded by upper and lower sealing surfaces for weather sealing said connecting section to said sill and said closure and mounting surfaces arranged for facing spaced relationship to said vertical sides, said inner section has an inner surface spaced from said facing surface thereof and upper, lower and opposite end surfaces bridging between said inner and facing surfaces thereof, said lower and facing surfaces define an air inlet communicating with said refrigerant evaporator, said inner surfaces defines an air outlet communicating with said refrigerant evaporator, and a fan is arranged within said inner section for drawing air through said air inlet and refrigerant evaporator and discharging said air through said air outlet, said outer section has an outer surface spaced from said facing surface thereof and upper, lower and opposite end surfaces bridging between said inner and facing surfaces thereof, said outer surface of said outer section defining an air outlet communicating with said refrigerant condenser, said opposite end surfaces of said outer section defining an air inlet communicating with said refrigerant condenser, said outer surface of said outer section, a fan is arranged within said outer section for drawing air through said inlet thereof and discharging air to said outlet thereof through said refrigerant condenser, said inner section has a condensate receiver to collect condensate collecting on said refrigerant evaporator from air passing therethrough, and conduit and pump means passing from said condensate receiver through said connecting section into said outer section are provided to remove condensate from said condensate receiver and discharge removed condensate for flow downwardly across said refrigerant condenser; adjustable length sealing devices arranged to removably extend horizontally from adjacent said mounting surfaces to said vertical sides and vertically between said upper and lower sealing surfaces; and latch devices for releasably latching said sealing devices against movement relative to said mounting surfaces.

5. An air conditioner unit adapted for insertion in a window opening of a building having interior and exterior wall surfaces adjacent said window opening, said window opening being bounded by a frame including a lower sill, a pair of vertical sides and a connecting upper end and closable by a closure movable within said frame, said unit comprising:

inner and outer sections adapted to be disposed relatively inwardly and outwardly of said interior and exterior wall surfaces, respectively; a connecting section sized to freely extend through said window opening and for rigidly interconnecting said inner and outer sections with a fixed spacing therebetween exceeding a distance, as measured between said interior and exterior wall surfaces, said inner and outer sections having facing surfaces, means for releasably retaining said facing surfaces in fixed position relative to said interior and exterior wall surfaces, said inner section housing a refrigerant evaporator, said outer section housing a refrigerant condenser and compressor and a refrigerant line passing therebetween and said connecting section housing refrigerant lines for connecting said evaporator to said compressor and said condenser to said evaporator, said connecting section having a generally rectangular cross-sectional configuration bounded by upper and lower sealing surfaces for weather sealing said connecting section to said sill and said closure and mounting surfaces arranged for facing spaced relationship to said vertical sides, said connecting section including an air flow conduit connecting interiors of said inner and outer sections and valve means for adjustably controlling flow of air through said air flow conduit; adjustable length sealing devices arranged to removably extend horizontally from adjacent said mounting surfaces to said vertical sides and vertically between said upper and lower sealing surfaces; and latch devices for releasably latching said sealing devices against movement relative to said mounting surfaces.

6. An air conditioner unit adapted for insertion in a window opening of a building having interior and exterior wall surfaces adjacent said window opening, said window opening being bounded by a frame including a lower sill, a pair of vertical sides and a connecting upper end and closable by a closure movable within said frame, said unit comprising:

inner and outer sections adapted to be disposed relatively inwardly and outwardly of said interior and exterior wall surfaces, respectively; a connecting section sized to freely extend through said window opening and for rigidly interconnecting said inner and outer sections with a fixed spacing therebetween exceeding a distance, as measured between said interior and exterior wall surfaces, said inner and outer sections having facing surfaces, means for releasably retaining said facing surfaces in fixed position relative to said interior and exterior wall surfaces, said inner section housing a refrigerant evaporator, said outer section housing a refrigerant condenser and compressor and a refrigerant line passing therebetween and said connecting section housing refrigerant lines for connecting said evaporator to said compressor and said condenser to said evaporator, said connecting section having a generally rectangular cross-sectional configuration bounded by upper and lower sealing surfaces for weather sealing said connecting section to said sill and said closure and mounting surfaces arranged for facing spaced relationship to said vertical sides, said connecting section including a pair of rigid channel members having opposite ends for supporting inner and outer sections, upper and lower panels for enclosing and fixing said channel members in a spaced parallel relationship, bracket means cooperating with said channel members and panels for defining an air flow opening communicating with said inner and outer sections, valve means arranged within said air flow conduit and including a valve plate for controlling flow of air through said air flow conduit and a valve plate supporting shaft, said shaft having one end journalled for rotation by said bracket means and an opposite end journalled by and extending outwardly of said connecting section transversely through one of said channel members, and control means connected to said opposite end for rotating said valve plate about a rotational axis of said shaft; adjustable length sealing devices arranged to removably extend horizontally from adjacent said mounting surfaces to said vertical sides and vertically between said upper and lower sealing surfaces; and latch devices for releasably latching said sealing devices against movement relative to said mounting surfaces.

7. An air conditioner unit adapted for insertion in a window opening of a building having interior and exterior wall surfaces adjacent said window opening, said window opening being bounded by a frame including a lower sill, a pair of vertical sides and a connecting upper end and closable by a closure movable within said frame, said unit comprising:

inner and outer sections adapted to be disposed relatively inwardly and outwardly of said interior and exterior wall surfaces, respectively; a connecting section sized to freely extend through said window opening and for rigidly interconnecting said inner and outer sections with a fixed spacing therebetween exceeding a distance, as measured between said interior and exterior wall surfaces, said inner and outer sections having facing surfaces, means for releasably retaining said facing surfaces in fixed position relative to said interior and exterior wall surfaces, said inner section housing a refrigerant evaporator, said outer section housing a refrigerant condenser and compressor and a refrigerant line passing therebetween and said connecting section housing refrigerant lines for connecting said evaporator to said compressor and said condenser to said evaporator, said connecting section having a generally rectangular cross-sectional configuration bounded by upper and lower sealing surfaces for weather sealing said connecting section to said sill and said closure and mounting surfaces arranged for facing spaced relationship to said vertical sides, an upper panel defines said upper sealing surface of said connecting section and upper surfaces of said inner and outer sections; a lower panel defines said lower sealing surface of said connecting section, said facing surfaces of said inner and outer sections and a lower surface of said outer section, said inner section additionally includes a front panel connected to said upper and lower panels to enclose said refrigerant evaporator, said front panel defines a lower surface of said inner section and cooperates with said facing surface of said inner section to define an air inlet communicating with said refrigerant evaporator, said front panel defines an air outlet communicating with said refrigerant evaporator, said outer section additionally includes a pair of opposite side panels edge connected to said upper and lower panels and cooperating therewith to enclose said refrigerant condenser and said compressor and define an air outlet communicating with said refrigerant condenser, at least one of said opposite side panels defining an air inlet communicating with said refrigerant condenser, and a pair of parallel rigid channel members are arranged to extend through said connecting section intermediate said upper and lower panels and have opposite ends thereof disposed within said inner and outer sections; adjustable length sealing devices arranged to removably extend horizontally from adjacent said mounting surfaces to said vertical sides and vertically between said upper and lower sealing surfaces; and latch devices for releasably latching said sealing devices against movement relative to said mounting surfaces.

8. A unit according to claim 7, wherein bracket means is fixed within said connecting section and cooperates with said channel members and said upper and lower panel members to define an air flow opening communicating with interiors of said inner and outer sections, and valve means is provided to adjustably control flow of air between said inner and outer sections through said air flow opening.

9. An air conditioner unit adapted for insertion in a window opening of a building having interior and exterior wall surfaces adjacent said window opening, said window opening being bounded by a frame including a lower sill, a pair of vertical sides and a connecting upper end and closable by a closure movable within said frame, said closure is defined by lower and upper window sashes, said unit comprising:

inner and outer sections adapted to be disposed relatively inwardly and outwardly of said interior and exterior wall surfaces, respectively; a connecting section sized to freely extend through said window opening and for rigidly interconnecting said inner and outer sections with a fixed spacing therebetween exceeding a distance, as measured between said interior and exterior wall surfaces, said inner and outer sections having facing surfaces, means for releasably retaining said facing surfaces in fixed position relative to said interior and exterior wall surfaces, said inner section housing a refrigerant evaporator, said outer section housing a refrigerant condenser and compressor and a refrigerant line passing therebetween and said connecting section housing refrigerant lines for connecting said evaporator to said compressor and said condenser to said evaporator, said connecting section having a generally rectangular cross-sectional configuration bounded by upper and lower sealing surfaces for weather sealing said connecting section to said sill and said closure and mounting surfaces arranged for facing spaced relationship to said vertical sides; adjustable length sealing devices arranged to removably extend horizontally from adjacent said mounting surfaces to said vertical sides and vertically between said upper and lower sealing surfaces, said lower sash being removably engageable with said upper sealing surface of said connecting portion and said sealing devices; latch devices for releasably latching said sealing devices against movement relative to said mounting surfaces; and latch means for releasably connecting said window sashes for preventing movement of said lower sash from engagement with said upper sealing surface and said sealing devices, said latch means including an operably latch part mounted on an upper extent or said lower sash, a movable latch part and adjustment means for mounting said movable latch part on a lower extent of said upper sash for operably aligning said movable latch part with said operable latch part when said lower sash is disposed in engagement with said upper sealing surface and said sealing devices and said upper sash is disposed in engagement with said upper end of said frame, said operably latch part being engageable with said movable latch part when said latch parts are in operative alignment for preventing relative movement of said lower and upper sashes.

10. A unit according to claim 9, wherein said adjustment means includes a first bracket fixed to said lower extent of said upper sash, a second bracket supported by said first bracket and carrying said movable latch part for movement therewith relative to said first bracket, and means for releasably attaching said second bracket to said first bracket in adjusted positions for arranging said movable latch part for alignment with said operable latch part.

11. A unit according to claim 9, wherein said adjustment means includes a mounting bracket fixed to said lower extent of said upper sash and having a movable latch part mounting surface formed with at least one mounting opening extending therethrough, a plurality of thin spacer plates adapted for removable placement on said latch part mounting surface in a stacked relationship and having mounting openings extending therethrough for alignment with said mounting opening of said latch part mounting surface, and fastener means extending through said mounting openings of said mounting surface and said plates for releasably clamping said one or more of said plates between said movable latch part and said latch part mounting surface, as required to place said movable latch part for alignment with said operable latch part.

* * * * *